US011761278B2

(12) United States Patent
Garcia

(10) Patent No.: US 11,761,278 B2
(45) Date of Patent: Sep. 19, 2023

(54) MODULAR CASING ANCHOR FOR DOWNHOLE TOOL

(71) Applicant: TAM INTERNATIONAL, INC., Houston, TX (US)

(72) Inventor: Luis Garcia, Kingwood, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 190 days.

(21) Appl. No.: 17/476,728

(22) Filed: Sep. 16, 2021

(65) Prior Publication Data

US 2022/0081983 A1 Mar. 17, 2022

Related U.S. Application Data

(60) Provisional application No. 63/079,658, filed on Sep. 17, 2020.

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 23/04115; E21B 33/1208; E21B 33/1277
See application file for complete search history.

(56) References Cited

U.S. PATENT DOCUMENTS 2,247,031 A * 6/1941 Norton ..... F16L 19/065 285/348
3,011,558 A * 12/1961 Conrad ..... E21B 23/04115 166/212
2007/0151724 A1* 7/2007 Ohmer ..... E21B 33/1208 166/187

* cited by examiner

*Primary Examiner* — Cathleen R Hutchins
*Assistant Examiner* — Ronald R Runyan
(74) *Attorney, Agent, or Firm* — Ewing & Jones, PLLC

(57) ABSTRACT

A modular tool anchor includes an anchor body positionable about a tubular. The anchor includes an anchor wedge for gripping against the tubular. A wedge drive screw engages a piston that biases the wedge into contact with the tubular as the wedge drive screw is tightened. The anchor also includes a compression seal positioned within the anchor body. A sealing flange abuts the compression seal. As seal compression screws are tightened, the sealing flange engages the compression seal and forces it against the tubular.

15 Claims, 5 Drawing Sheets

MODULAR CASING ANCHOR FOR DOWNHOLE TOOL

CROSS-REFERENCE TO RELATED APPLICATIONS

This application is a nonprovisional application which claims priority from U.S. provisional application No. 63/079,658, filed Sep. 17, 2020, the entirety of which is hereby incorporated by reference.

TECHNICAL FIELD/FIELD OF THE DISCLOSURE

The present disclosure relates generally to downhole tools, and more specifically to devices for coupling and sealing a downhole tool to a tubular.

BACKGROUND OF THE DISCLOSURE

Certain downhole tools are positioned on the outside of a tubular to be placed in a wellbore. Such downhole tools need to be coupled to the tubular and, in certain cases, need to be sealed to the tubular. However, due to variations in diameter of the tubular, traditional seals such as O-rings may not provide adequate sealing for the entire range of nominal tubular diameters encountered.

SUMMARY

The present disclosure provides for a modular tool anchor. The modular tool anchor may include an anchor body, the anchor body positioned about a tubular. The modular tool anchor may include an anchor wedge positioned within a pocket formed in the anchor body, the anchor wedge including a first wedge surface, the first wedge surface engaging a tapered face of the pocket. The modular tool anchor may include a piston, the piston positioned within a piston bore formed in the anchor body, the piston bore aligned with the pocket. The modular tool anchor may include a wedge drive screw, the wedge drive screw positioned within the piston bore and threadedly coupled to the anchor body, the wedge drive screw abutting the piston.

The present disclosure also provides for a modular downhole tool anchor. The modular tool anchor may include an anchor body, the anchor body positioned about a tubular. The modular tool anchor may include a compression seal, the compression seal being annular and positioned within the anchor body. The modular tool anchor may include a sealing flange, the sealing flange including a tapered seal flange face, the tapered seal flange face abutting the compression seal, the sealing flange threadedly coupled to the anchor body by a seal compression screw.

The present disclosure also provides for a method for coupling a downhole tool to a tubular. The method may include positioning the downhole tool about the tubular. The method may include tightening a wedge drive screw such that an anchor wedge is biased radially inward from an anchor body of the downhole tool into contact with the tubular. The method may include tightening a seal compression screw such that a compression seal is biased radially inward from the anchor body into contact with the tubular.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
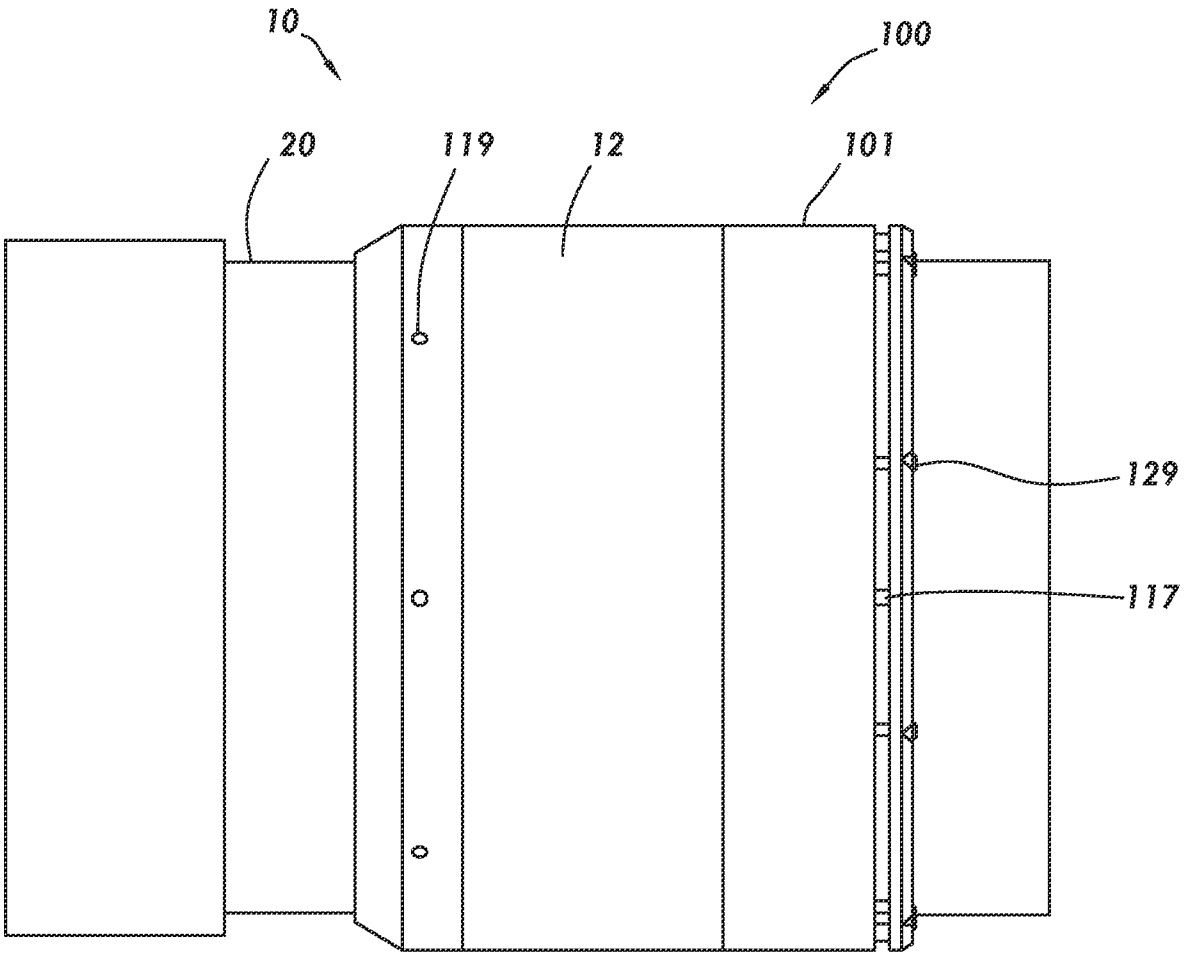
FIG. 1 depicts a side view of a downhole tool including a modular casing anchor consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
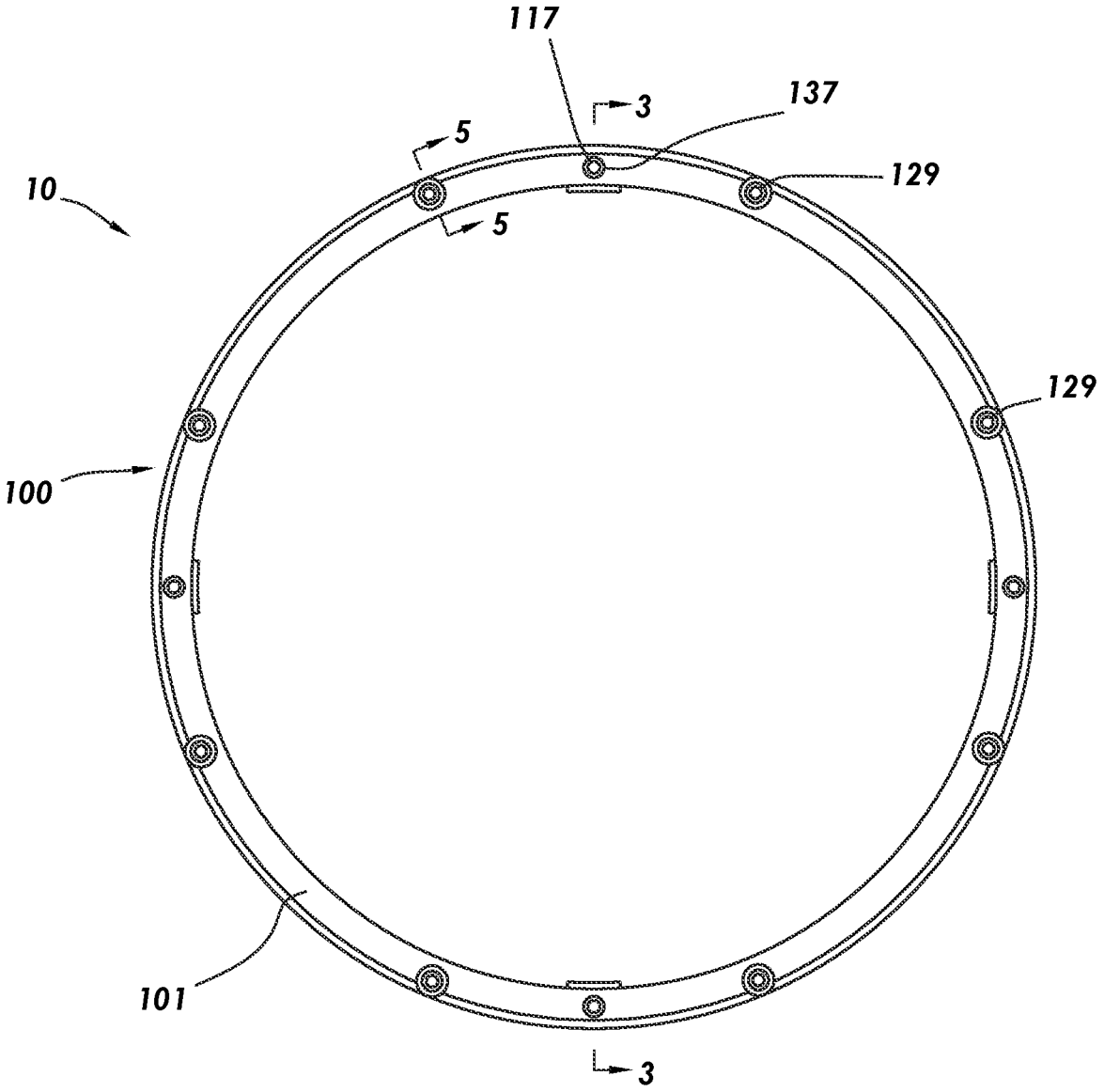
FIG. 2 depicts an end view of the downhole tool of FIG. 1.

FIGS. 1, 2 depict downhole tool 10. Downhole tool 10 may be any tool to be positioned about tubular 20 such as a length of casing. For example and without limitation, in some embodiments, downhole tool 10 may be a packer. In such an embodiment, downhole tool 10 may include packer body 12, which may be formed from a swellable material.

Figure 3:
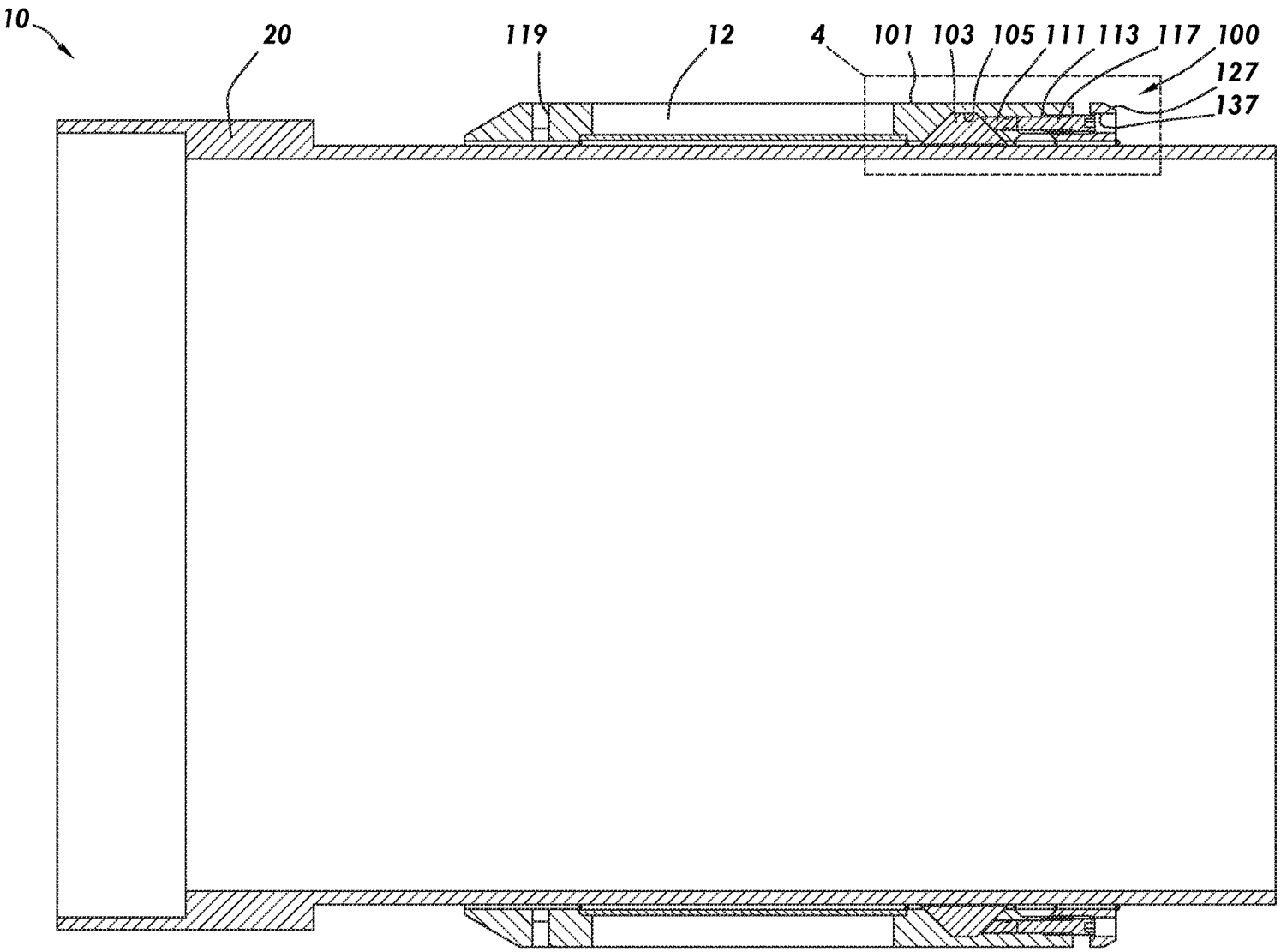
FIG. 3 depicts a cross section view of the downhole tool of FIG. 2 at line 4-4.

Downhole tool 10 may include modular casing anchor 100. Modular casing anchor 100 may be used to couple downhole tool 10 to the outer surface of tubular 20. In some embodiments, modular casing anchor 100, as shown in FIG. 3, may include anchor body 101. Anchor body 101 may be annular or tubular in shape and may be sized such that tubular 20 fits within anchor body 101.

Figure 4:
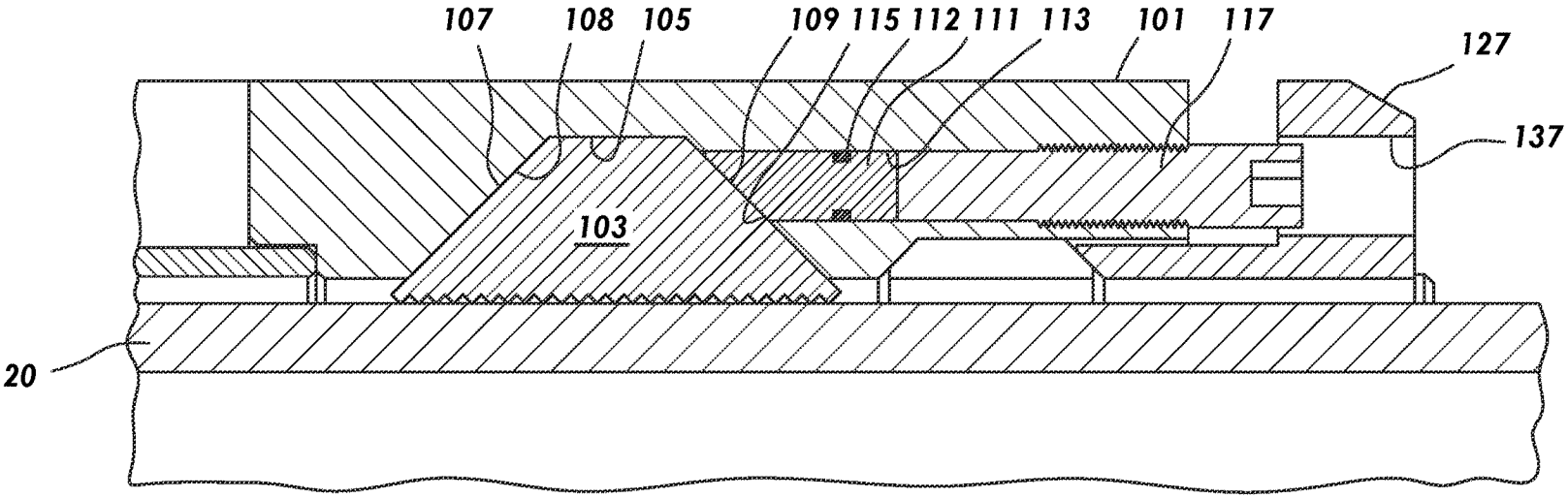
FIG. 4 depicts a detail cross section view of the downhole tool of FIG. 3.

In some embodiments, modular casing anchor 100 may include anchor wedges 103. Anchor wedges 103 may be positioned within wedge pockets 105 formed in anchor body 101. As shown in FIG. 4, anchor wedges 103 may be trapezoidal in cross-section such that first wedge surface 107 abuts tapered face 108 of anchor body 101. Although four anchor wedges 103 are shown, modular casing anchor 100 may include any number of anchor wedges 103 within the scope of this disclosure. For example, in some embodiments, modular casing anchor 100 may include three or more anchor wedges 103.

In some embodiments, anchor wedges 103 may include second wedge surface 109. Second wedge surface 109 may be positioned to engage piston 111. Piston 111 may be generally cylindrical and may be positioned within piston bore 113 formed in anchor body 101. Piston bore 113 may be formed generally parallel to the longitudinal axis of modular casing anchor 100. Piston 111 may include tapered piston face 115. Tapered piston face 115 may abut second wedge surface 109. In some embodiments, piston 111 may include piston seal 112 positioned to fluidly seal between piston 111 and piston bore 113.

Figure 4A:
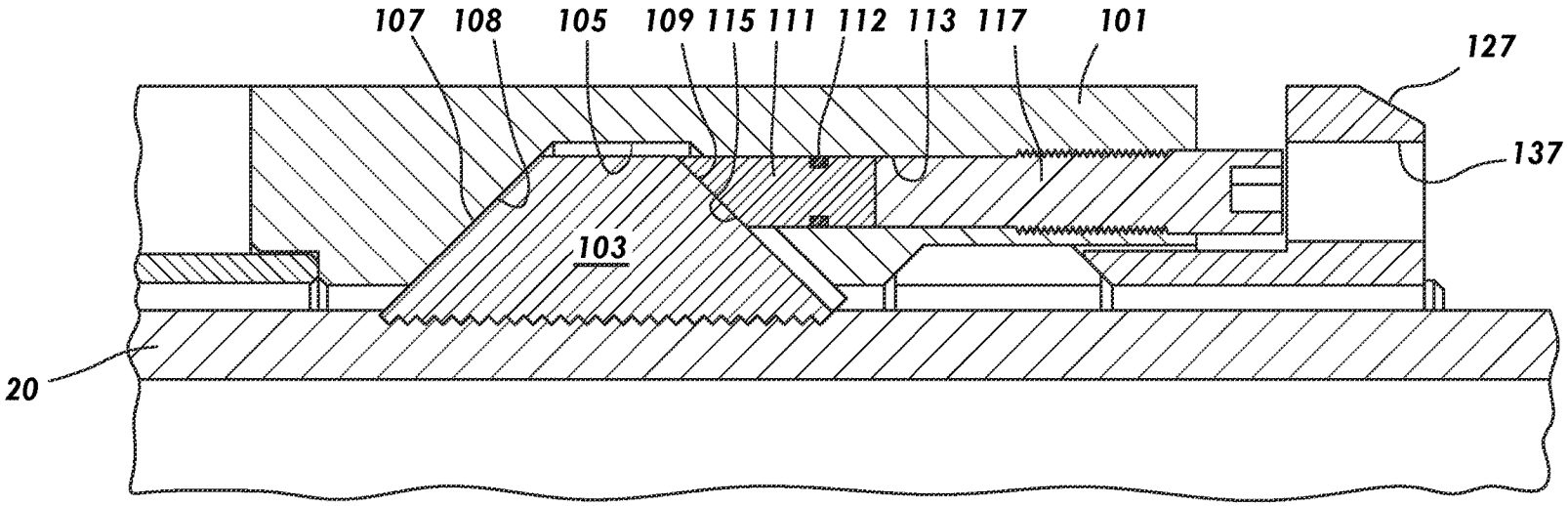
FIG. 4A depicts a detail cross section view of the downhole tool of FIG. 3 in an anchored position.

In some embodiments, modular casing anchor 100 may include wedge drive screws 117. Wedge drive screws 117 may be positioned at least partially within and threadedly coupled to piston bore 113. Wedge drive screws 117 may be positioned to bias piston 111 toward anchor wedge 103 as wedge drive screws 117 are rotated. As piston 111 moves toward anchor wedge 103, longitudinal force is applied to anchor wedge 103 between piston 111 and anchor body 101. Due to the angled interface between tapered face 108 and first wedge surface 107 and tapered piston face 115 and second wedge surface 109, such longitudinal force may cause anchor wedge 103 to move radially inward relative to anchor body 101 and into engagement with tubular 20 as shown in FIG. 4A. By engaging each anchor wedge 103 of modular casing anchor 100 to tubular 20, modular casing anchor 100 may be mechanically coupled to tubular 20.

In some embodiments, with reference to FIG. 3, modular casing anchor 100 may include centering screws 119. Centering screws 119 may be threadedly coupled to anchor body 101 at an end of anchor body 101 opposite anchor wedges 103. Centering screws 119 may extend radially through anchor body 101. Upon installation of modular casing anchor 100 to tubular 20, before or after engagement of anchor wedges 103, centering screws 119 may be rotated until tubular 20 is engaged. By adjusting the inward extension of centering screws 119 and anchor wedges 103, anchor body 101 may be centered relative to tubular 20 and may be aligned with tubular 20.

Figure 5:
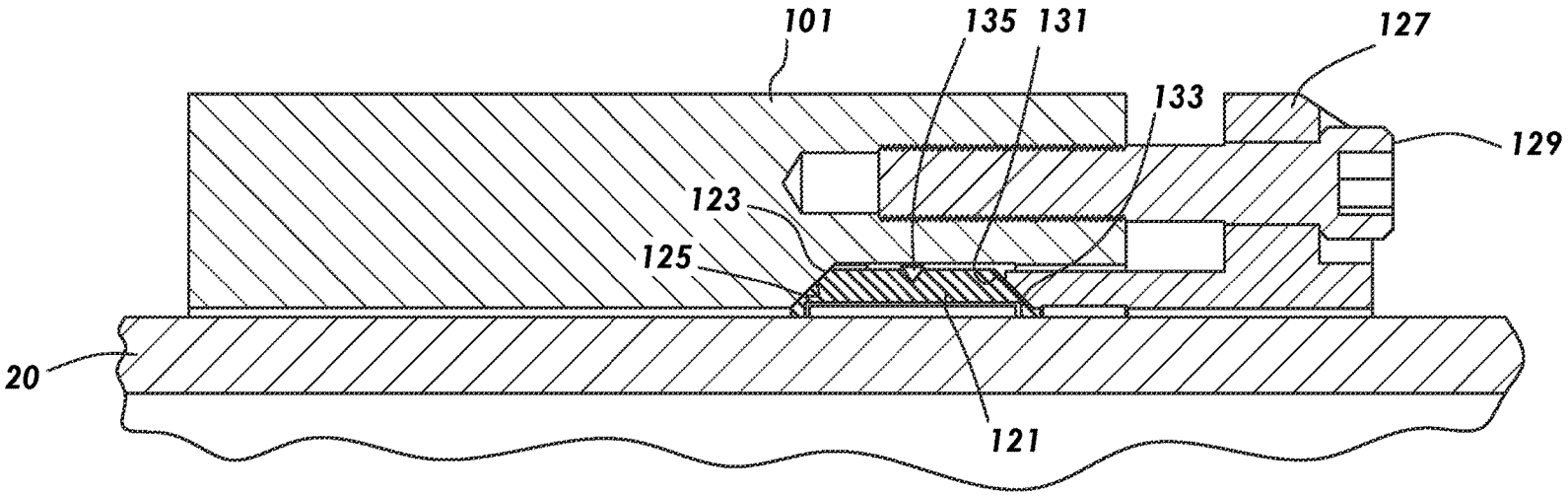
FIG. 5 depicts a detail cross section view of the downhole tool of FIG. 2 at line 5-5.

In some embodiments, with reference to FIG. 5, modular casing anchor 100 may include compression seal 121. Compression seal 121 may be positioned on an inner surface of anchor body 101. In some embodiments, compression seal 121 may be substantially trapezoidal in cross section such that first tapered seal surface 123 abuts tapered seal body face 125.

In some embodiments, modular casing anchor 100 may include sealing flange 127. Sealing flange 127 may be annular or tubular in shape and may be threadedly coupled to anchor body 101 by seal compression screws 129. Seal compression screws 129 may extend substantially parallel to the longitudinal axis of modular casing anchor 100. Sealing flange 127 may include tapered seal flange face 131 positioned to abut second tapered seal surface 133 of compression seal 121.

Figure 5A:
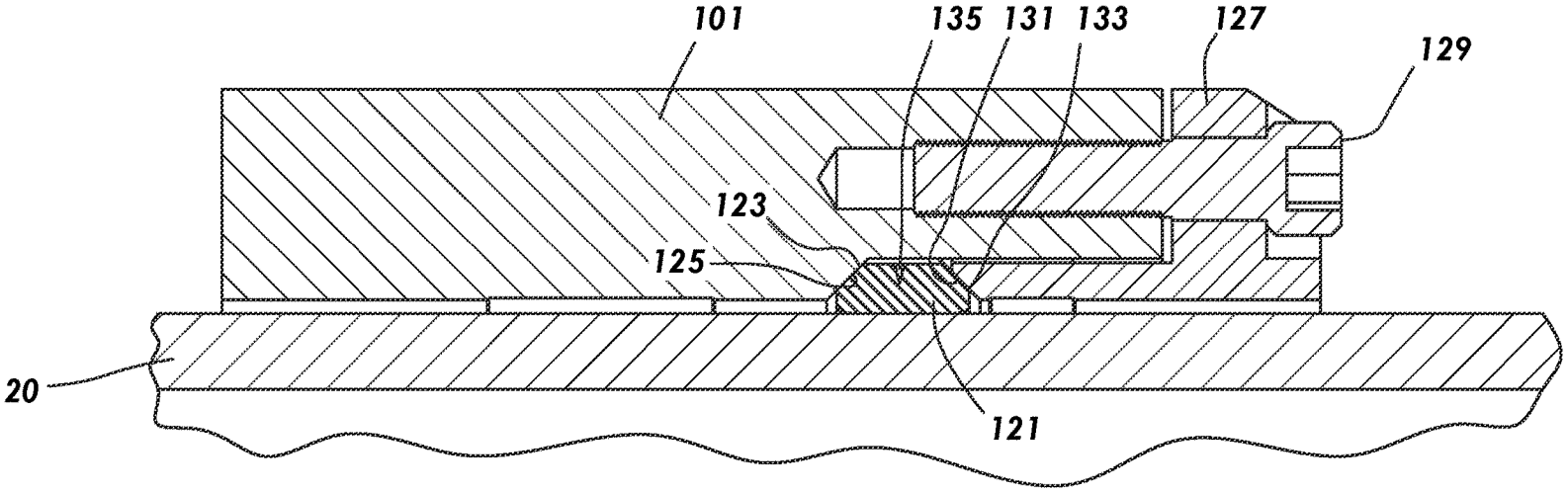
FIG. 5A depicts a detail cross section view of the downhole tool of FIG. 5 in a sealed position.

In some embodiments, as seal compression screws 129 are tightened, sealing flange 127 may be biased toward anchor body 101 and thereby impart a longitudinal compression force on compression seal 121 between tapered seal flange face 131 and tapered seal body face 125. Such compression may deform compression seal 121 into engagement with tubular 20 as shown in FIG. 5A, thereby forming a fluid seal between anchor body 101 and tubular 20.

In some embodiments, compression seal 121 may include circumferential groove 135 formed in the radially outward face of compression seal 121. Circumferential groove 135 may, in some embodiments, promote buckling of compression seal 121 such that compression seal 121 more readily contacts tubular 20.

In some embodiments, with reference to FIG. 2, sealing flange 127 may include one or more access holes 137 formed therein. In some such embodiments, access holes 137 may be positioned to align with wedge drive screws 117 such that wedge drive screws 117 may be accessed for actuation of anchor wedges 103 through sealing flange 127.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A modular tool anchor comprising:

an anchor body, the anchor body positioned about a tubular;

an anchor wedge positioned within a pocket formed in the anchor body, the anchor wedge including a first wedge surface, the first wedge surface engaging a tapered face of the pocket and a second wedge surface, the second wedge surface abutting a tapered piston face of a piston;

the piston, the piston positioned within a piston bore formed in the anchor body, the piston bore aligned with the pocket; and a wedge drive screw, the wedge drive screw positioned within the piston bore and threadedly coupled to the anchor body, the wedge drive screw abutting the piston.

2. The modular tool anchor of claim 1, further comprising a seal positioned between the piston and the piston bore.

3. The modular tool anchor of claim 1, further comprising:

a compression seal, the compression seal being annular and positioned within the anchor body; and a sealing flange, the sealing flange including a tapered seal flange face, the tapered seal flange face abutting the compression seal, the sealing flange threadedly coupled to the anchor body by a seal compression screw.

4. The modular tool anchor of claim 3, wherein the sealing flange further comprises an access hole, the access hole aligned with the wedge drive screw.

5. The modular tool anchor of claim 3, wherein the compression seal includes a circumferential groove formed in the radially outer surface of the compression seal.

6. The modular tool anchor of claim 1, further comprising a centering screw, the centering screw extending radially through the anchor body.

7. The modular tool anchor of claim 1, further comprising a swellable packer element coupled to the anchor body.

8. A modular downhole tool anchor comprising:

an anchor body, the anchor body positioned about a tubular;

a compression seal, the compression seal being annular and positioned within the anchor body wherein the compression seal includes a circumferential groove formed in a radially outer surface of the compression seal; and a sealing flange, the sealing flange including a tapered seal flange face, the tapered seal flange face abutting the compression seal, the sealing flange threadedly coupled to the anchor body by a seal compression screw.

9. The modular tool anchor of claim 8, further comprising:

an anchor wedge positioned within a pocket formed in the anchor body, the anchor wedge including a first wedge surface, the first wedge surface engaging a tapered face of the pocket;

a piston, the piston positioned within a piston bore formed in the anchor body, the piston bore aligned with the pocket; and a wedge drive screw, the wedge drive screw positioned within the piston bore and threadedly coupled to the anchor body, the wedge drive screw abutting the piston.

10. The modular tool anchor of claim 9, wherein the anchor wedge further comprises a second wedge surface, the second wedge surface abutting a tapered piston face of the piston.

11. The modular tool anchor of claim 9, further comprising a seal positioned between the piston and the piston bore.

12. The modular tool anchor of claim 8, wherein the sealing flange further comprises an access hole, the access hole aligned with the wedge drive screw.

13. The modular tool anchor of claim 8, further comprising a centering screw, the centering screw extending radially through the anchor body.

14. The modular tool anchor of claim 8, further comprising a swellable packer element coupled to the anchor body.

15. A method for coupling a downhole tool to a tubular comprising:

positioning the downhole tool about the tubular;

tightening a wedge drive screw such that an anchor wedge is biased radially inward from an anchor body of the downhole tool into contact with the tubular; and tightening a seal compression screw such that a compression seal is biased radially inward from the anchor body into contact with the tubular wherein the compression seal includes a circumferential groove formed in a radially outer surface of the compression seal.

* * * * *